US005830079A

United States Patent [19]

Hudson

[11] Patent Number: 5,830,079

[45] Date of Patent: Nov. 3, 1998

[54] STANCE AND MOVEMENT SWING TRAINING APPARATUS FOR GOLF AND OTHER SPORTS

[75] Inventor: Christopher L. Hudson, Winter Park, Fla.

[73] Assignee: Charles S. Fizer, III, Winter Park, Fla.

[21] Appl. No.: 986,173

[22] Filed: Dec. 5, 1997

[51] Int. Cl.[6] ..... A63B 69/36

[52] U.S. Cl. ..... 473/272; 473/273; 473/452

[58] Field of Search ..... 473/218, 271, 473/272, 273, 277

[56] References Cited

U.S. PATENT DOCUMENTS

| | | | |
|---|---|---|---|
| 1,936,143 | 11/1933 | Shea | 473/271 X |
| 3,623,733 | 11/1971 | Cavanaugh | 273/183 B |
| 4,651,994 | 3/1987 | Lee | 273/183 B |
| 4,659,084 | 4/1987 | Vuick | 273/183 B |
| 4,895,372 | 1/1990 | Muller | 273/183 B |
| 4,993,716 | 2/1991 | Waller | 273/183 B |
| 5,203,569 | 4/1993 | Rilling | 273/187.2 |
| 5,288,074 | 2/1994 | Scheurer | 273/183 R |
| 5,591,090 | 1/1997 | Kauffman, Jr. | 473/271 |
| 5,634,858 | 6/1997 | Bellagamba | 473/271 X |

*Primary Examiner*—George J. Marlo
*Attorney, Agent, or Firm*—Edward M. Livingston, Esq.

[57] ABSTRACT

A swing stance and movement training apparatus (1) primarily for golf, but also for baseball and other swinging sports, having a buttocks bar (7), a rear hip bar (9) and rear knee brace (11) mounted on vertical supports (3 and 5, 10*a* and 10*b*, and 15*a* and 15*b* respectively) at a height to abut a particular user's buttocks, hip and knees during a swing. The height of the buttocks bar (7), hip bar (9) and knee brace (11) may be adjustable by telescopically or slidably engaged top and bottom sections. The knee brace (11) may be further adjusted forward and backward by use of sliding plates (12, 13). The apparatus may be permanently positioned by installing the vertical supports (3, 5, 10*a*, 10*b*) in or to a surface. However, preferably it would be made portable by attaching the vertical supports to a platform (2) on which the user stands. The buttocks and hip bars and knee brace may be interconnected by cross bars (25) and floor bars (26, 4) between the vertical supports. A stabilizing bar (22) with brace (16) may be attached to a vertical support of the buttocks and hip bars on a side opposite the platform to keep the apparatus from tipping during use. The platform may further have ball placement and hitting direction aid lines (19 and 18, respectively). The portable version of the apparatus may be collapsible for easy carrying and storage.

32 Claims, 2 Drawing Sheets

STANCE AND MOVEMENT SWING TRAINING APPARATUS FOR GOLF AND OTHER SPORTS

BACKGROUND OF THE INVENTION

This invention relates to a swing training device and more particularly, a device to teach proper stance and angular movement while swinging a golf club or other object, such as a baseball bat.

Proper stance, weight shift and angular movement are very important in any sport requiring swinging, especially golf. Many golfers shift too much weight to the rear leg, which if not fully transferred to the center of the stance during the down swing of the club, results in a shorter drive and/or "topping" the ball.

Another problem experienced by many golfers is an improper hip rotation. Many golfers, in an attempt to get maximum angular momentum, rotate their hips excessively, thereby causing reverse pivot which can result in slicing of the golf ball or an insufficient drive. Conversely, insufficient hip rotation limits the full potential of the swing and results in shorter drives of the golf ball.

An understanding of the physics behind the golf swing is important toward an understanding of this invention. Two types of energy are involved in swinging, potential energy and kinetic energy. Potential energy takes place when one loads the rear side of the body by proper weight shift and hip rotation before transferring the potential energy into kinetic energy during the swing and follow through. The golf swing can be divided into three parts, the address/impact area, the top of the back swing and the finishing position. The club face starts at the address/impact area and then goes to the top of the back swing only to return again to the address/impact area and then follow through into the finishing position. It is important that the top of the back swing position be loaded with maximum potential energy so that the kinetic energy is at its highest point when returning to the impact area as it is at the impact area that a person must transfer 100% of the kinetic energy into the ball.

Thus, there is a need for a device which will teach proper stance, weight shift and angular movement of the hip and body which will program the muscles to make the proper movements to result in muscle memory. By using the present invention, the muscle memory will result in the golfer performing the same movement on the golf course when the device is not available.

Generally, some other products have tried to achieve the same results, but are unable to do so because the products are fundamentally unsound. Some devices place restrictions on the forward-facing side of the body as a reminder to turn the body from the impact position to the finish position. Unfortunately, placing such restrictions on the body acts as a deterrent or interruption in the completion of the golf swing, thereby preventing the natural laws of physics for the transfer of potential energy and kinetic energy from taking place.

Still other devices attempt to restrict head movement. If a person is not allowed to move his or her head during the golf swing it can create problems, such as an improper spine angle and a reversed weight shift. A golfer's head must move during a swing as the club head will pull the body and head through the impact area and into the follow through position since one cannot defy gravity or centrifugal force.

Even other products provide auditory mechanisms when a person moves past a certain position in a golf swing.

Unfortunately, such auditory mechanisms do not teach the golfer the proper swing and create dependency on auditory noise which is not available when a golfer is playing on a golf course.

The present invention avoids the above problems and teaches the golfer the proper stance, weight shift and angular movement of the body through practice, which reduces movement to muscle memory that is repeatable on the golf course.

The known prior patented art includes numerous golf swing training devices, but none that work in the same manner nor have the same structure as the present device. U.S. Pat. No. 5,203,569 issued to Rilling on Apr. 20, 1993, teaches a golf stance trainer with buttocks, hip and leg monitor supports having sensors to signal improper movement. Rilling relies on an audible response that will not be present on the golf course. Furthermore, Rilling uses moveable braces which would allow a golfer to rotate or move past the points necessary for proper balance and angular movement. Furthermore, Rilling restrains the golfer on the forward-facing side which prevents the proper freedom of movement necessary for peak linear and angular momentum.

U.S. Pat. No. 4,895,372 issued to Muller on Jan. 23, 1990, teaches an upright device with knee, hip and head guides mounted on a platform. Although the Muller device places a pad behind a golfer's rear knee, it would still allow the center of gravity to change or the axis of the swing to shift, thereby adversely affecting the down swing. Furthermore, the Muller device concentrates on keeping the head stationary, which causes the problems discussed hereinabove. Furthermore, the Muller device requires the golfer to stand on an elevated platform and hit a ball off an elevated platform which can adversely affect a golfer's swing when on the golf course.

U.S. Pat. No. 5,591,090 issued to Kauffman, Jr. on Jan. 7, 1997, discloses a golf training device having a platform with an upright back leg support to defer swaying during the golf swing. This device allows the hip to have unrestricted hip movement or rotation in either direction, which unlike the present device, could result in an improper golf swing.

U.S. Pat. No. 4,651,994 issued to Lee on Mar. 24, 1987, discloses another golf swing training device to eliminate sway and leg movement, which uses a platform with an upright rear leg support and a front leg post to keep the front leg from moving backwards.

U.S. Pat. No. 4,993,716 issued to Waller on Feb. 19, 1991, teaches a golf stance alignment device with front knee support and a neck brace.

U.S. Pat. No. 4,659,084 issued to Vuick on Apr. 21, 1987, discloses a golf swing training apparatus with a forward leg brace and head support. Again, like Waller, this device works differently and is structured differently from the present invention.

U.S. Pat. No. 5,288,074 issued to Scheurer on Feb. 22, 1994 teaches a device to restrict hip movement which uses a horseshoe-shaped restrictor against the hips. Unfortunately, the Scheurer device allows movement in proportion to the golfer's hip, which results in the loss of angular momentum.

U.S. Pat. No. 3,623,733 issued to Cavanaugh on Nov. 30, 1971, discloses another golf swing practice apparatus with adjustable uprights on both the front and back of the hips to control hip movement. As with all other patented inventions in the prior art, the Cavanaugh device is structured differently and does not accomplish the same purposes as the present invention.

In summary, the present invention provides a novel device and solution to the problems created by improper stance, weight shift and angular movement when swinging a golf club, bat or other object.

SUMMARY OF THE INVENTION

A primary object of the present invention is to teach the proper stance and posture for swinging.

Another object of the present invention is to teach the proper angular movement hip rotation to be used when swinging a golf club.

Another object of the present invention is to teach the proper weight shift and loading of the rear side of the body during a swing.

A further object of the present invention is to enable one to practice repeatedly the proper swing to instill muscle memory.

An even further object of the present invention is to teach a swing that is safe so that a person does not injure him or herself while swinging.

The present invention fulfills the above and other objects by providing a swing stance and movement training apparatus for golf and other swing sports having three restrictive supports against which the buttocks, hips and knees abut during the swinging process. A horizontal buttocks bar is mounted on a vertical support at the height of a person's buttocks. A rear hip bar is mounted at a rear of the horizontal bar against which a person's rear hip may abut during a swing. Finally, a knee brace is mounted on a vertical support at approximately knee height aft of the hip bar against which a person's rear knee will abut during a swing. Although the three components of this invention could be mounted in a permanent fashion in the ground or on another surface, it would preferably be mounted on a platform on which a person can stand during the swing. The horizontal buttocks bar with perpendicularly attached hip bar at the rear may be simultaneously adjustable to fit the height of various users' buttocks and hips. The knee brace would be adjustable in height as well according to the height of a user's knee. The knee brace would be further adjustable forward and backward depending on the sway of the user. In order to provide more stability and prevent the apparatus and platform from tipping due to pressure of the buttocks against the rear hip bar, a support bar is provided at the base of the apparatus on the side of the apparatus opposite the platform. The platform may be marked with ball positioning and hitting aid lines.

The above and other objects, features and advantages of the present invention should become even more readily apparent to those skilled in the art upon a reading of the following detailed description in conjunction with the drawings wherein there is shown and described preferred embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
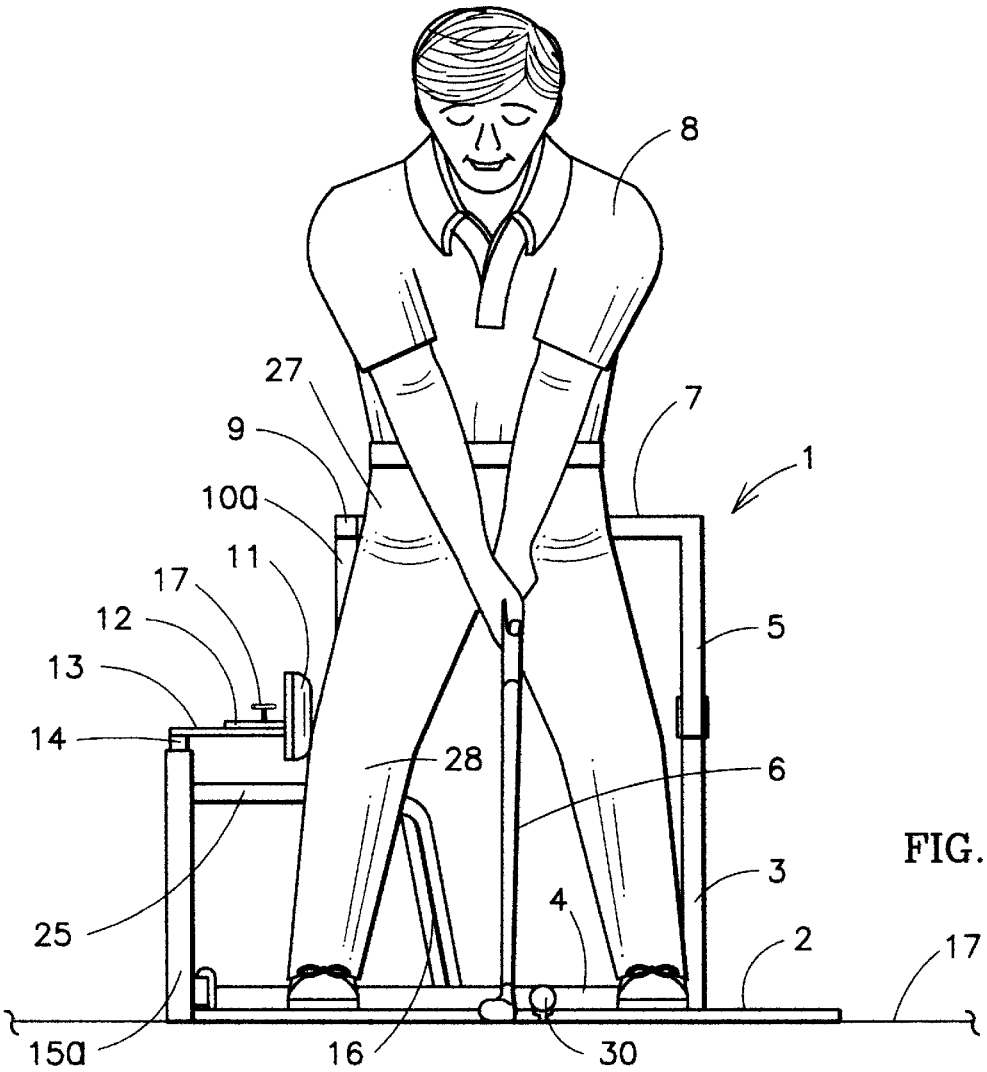
FIG. 1 is a side view of the golf training apparatus of the present invention being used by a golfer.
Figure 2:
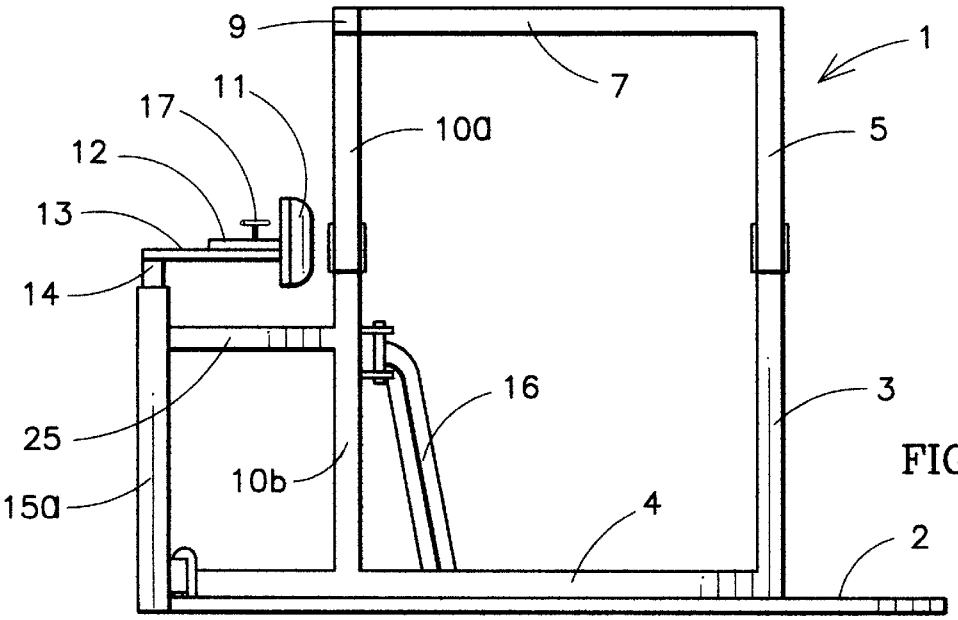
FIG. 2 is a side view of the training apparatus without a golfer.

For purposes of describing the preferred embodiment, the terminology used in reference to the numbered components in the drawings is as follows:

| | |
|---|---|
| 1. | apparatus, generally |
| 2. | standing pad/platform |
| 3. | lower front leg of back bar |
| 4. | floor bar |
| 5. | upper front leg of buttocks bar |
| 6. | golf club |
| 7. | buttocks bar |
| 8. | golfer |
| 9. | hip bar |
| 10a. | upper rear leg for buttocks bar |
| 10b. | lower rear leg for buttocks bar |
| 11. | padded rear knee brace |
| 12. | rear knee brace adjustment plate |
| 13. | rear knee brace plate |
| 14. | height adjustment post for knee pad |
| 15a,b. | knee brace support posts |
| 16. | brace for floor support bar |
| 17. | threaded knee pad adjustment knob |
| 18. | ball direction line |
| 19. | ball positioning line |
| 20. | front height adjustment bar for back post |
| 21. | threaded knob for front height adjustment bar (20) |
| 22. | stabilizing floor support bar |
| 23. | threaded knob for rear height adjustment bar (20) |
| 24. | rear height adjustment bar for back post |
| 25. | connecting bar |
| 26. | floor bar for knee brace section(?) |
| 27. | rear hip of golfer |
| 28. | rear knee of golfer |
| 29a,b. | adjustment slots in the knee brace |
| 30. | golf ball |

Figure 3:
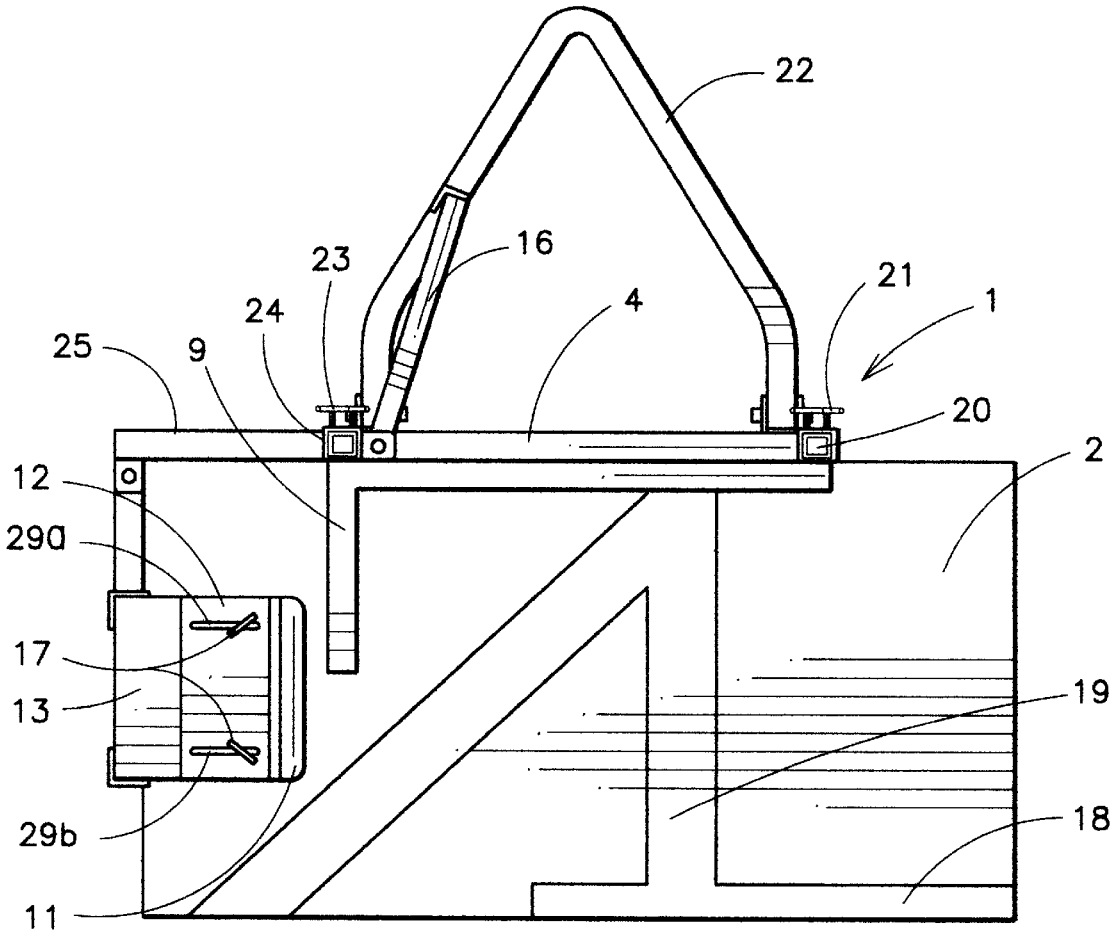
FIG. 3 is a top view of the training apparatus.
Figure 4:
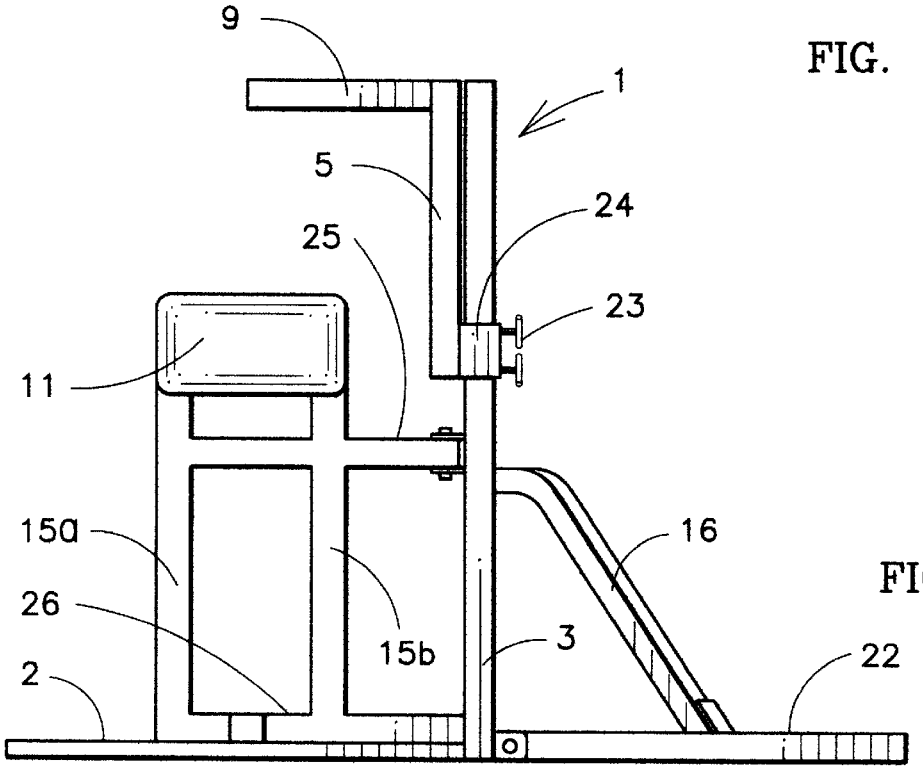
FIG. 4 is a front view of the training apparatus.

Referring to FIG. 1 the golf training apparatus generally 1 is shown being used by a golfer 8 holding a golf club 6. The golf apparatus 1 contains three primary components, a horizontal bar 7 positioned to make contact with the buttocks of the golfer 8, a bar 9 mounted at the rear of and perpendicularly to the buttocks bar 7, designed to contact the rear hip 27 and a knee brace 11 positioned to make contact with the rear knee 28. The afore-referenced components are mounted on vertical posts or legs at a height suitable to the golfer 8. For instance, the buttocks and hip bars 7 and 9, respectively, are mounted on a front leg 3 and 5 and rear leg 10*a* and 10*b*. The knee brace 11 is mounted on a vertical leg or post 15 and 14 shorter than the vertical legs on which the buttocks and hip bars 7 and 9, respectively, are mounted. Each of the latter vertical legs or posts is preferred to be slidably adjustable by one leg portion fitting into the other portion in telescoping fashion or by a sliding on the separate portions. For instance, the buttocks bar 7 and hip bar 9 are adjustable in height at the same time by removing locking pins 21 and 23 shown in FIG. 3, then pulling upward on the buttocks bar 7 to pull the upper leg portions 5 and 10*a*, respectively, out of the lower portions 3 and 10*b*, respectively, until the buttocks bar 7 is at the height of the buttocks of the user 8. Once the proper height is obtained, the locking pins 21 and 23 can then be inserted into place.

The knee brace 11 is also adjustable in height by pulling upward on the height adjustment post 14 and then locking the height adjustment post 14 by inserting a pin in holes in the post. The knee brace 11 can also be adjusted forward or backward by attaching it to an adjustment plate 12, which in turn is mounted to a brace plate 13 and providing threaded knobs 29*a* and 29*b* which may be untightened and then the knee brace 11 moved to the desired position by means of slots 29*a* and 29*b* in the adjustment plate 12 and the knobs 29*a* and 29*b* retightened.

The apparatus 1 may consist of two separate pieces, one having the buttocks bar 7 with hip bar 9 and the second separate piece holding the knee brace 11 if both are mounted permanently into the ground or other surface 17. However, preferably in order to make the device portable, the two separate pieces would preferably be interconnected by connecting interconnecting bar 25 and floor bar 4, all mounted on a platform 2 on which the user 8 would stand. In the portable embodiment the device might require a stabilizing floor support bar 22 with brace 16 connecting it to the rear upright 10*a* and 10*b* of the buttocks bar 7. This stabilizing bar 22 could be triangular in shape and would extend outward from the side opposite the platform 2. The stabilizing bar 22 would keep the apparatus 1 from tipping, particularly when the user leans his or her buttocks against the buttocks bar 7.

The platform 2 of the apparatus may contain a ball positioning line 19 and ball hitting direction lines 18, if desired.

The entire device can be made collapsible by providing four hinges and rotatable bolts at various contact points, such as between the platform 2 and the floor bar 4, the support bar 22 and floor bar 4, the knee brace connecting bar 25 and knee brace floor bar 26 and the lower rear post 10*b* and floor bar 4. When collapsible the device could be carried by one person and quickly set up for use anywhere.

To use the apparatus 1 the golfer 8 must step onto the platform 2. When a golfer 2 stands on the apparatus 1 he or she is forced into the proper swinging posture against the buttocks and hip bars 7 and 9, respectively, and the knee brace 11, assuming such are adjusted to the proper heights of the buttocks/hip and knee of the user.

As the golfer 8 starts to move the club 6 away from the ball 30 in a back swing, the knee brace 11, which is preferably padded, provides rigid resistance so that the rear knee 28 is not allowed to move laterally beyond a certain degree. Without the apparatus, a golfer's knee could move excessively backward and to the side in the back swing, therefore changing the body's center of gravity, which would require that the body compensate in the down swing, often resulting in a poor shot.

Once the club 6 reaches a position parallel in the back swing to the surface 17, the rigid resistance and 90° angle of the hip bar 9 and buttocks bar 7 prevents the person 8 from rotating his or her hip past a 45° angle relative to the direction in which the ball 30 is to be hit. By prohibiting a person from rotating his or her hip past a 45° angle, he or she is forced to complete the golf swing by rotating his or her upper body instead.

During the swing the buttocks bar 7 which abuts the person's buttocks, makes the person maintain an athletic position throughout the golf swing and provides rigid resistance so that the person will not move laterally in a backward motion. Another purpose of the buttocks bar 7 is to force the person to maintain the proper angle in the lower body and feel what it is like to "stay down on the shot" or "sit on the fence," common terms often used when teaching a proper golf swing.

During the golf swing the knee brace 11 provides sufficient resistance against the rear knee 28 of the golfer 8, yet allows the golfer's weight to be shifted backward sufficiently yet prevents a reverse pivot or excessive weight transfer. Without the present apparatus if a golfer excessively transfers weight to his or her rear leg, such may not be fully transferred forward during the golf swing. By having the knee brace 11 this prevents excessive weight transfer from taking place.

Although a preferred embodiment of the swing apparatus has been discussed in relation to the sport of golf, this apparatus may also be used to practice swinging a bat for baseball as well. Golf and baseball swings are very similar with perhaps the only difference being that the swings are on different planes. When practicing a swing in either golf or baseball, this apparatus teaches muscle memory so that the user will automatically assume the proper stance and the proper movements when out on the golf course or in the batter's box.

Although only some embodiments of the present invention have been described in detail hereinabove, all improvements and modifications to this invention within the scope or equivalents of the claims are intended to be covered by this invention.

Having thus described my invention, I claim:

1. A swing stance and movement training apparatus for golf and other swinging sports comprising:

a horizontal buttocks bar mounted on a vertical support above a surface at a height approximate to a user's buttocks against which the user's buttocks may abut during a swing;

a hip bar mounted at a rear of and perpendicularly to the horizontal buttocks bar against which the user's rear hip may abut during a swing; and a knee brace mounted on a vertical support positioned at approximately knee high and slightly aft of the hip bar against which the user's rear knee may abut during a swing.

2. The apparatus of claim 1 further comprising a platform on which the user stands, said platform being attached to the vertical supports of the buttocks bar and knee brace.

3. The apparatus of claim 2 wherein the buttocks bar and hip bar are simultaneously adjustable in height to the height of various users' buttocks and hips.

4. The apparatus of claim 3 wherein the knee brace is adjustable in height to a height of various users' knees.

5. The apparatus of claim 4 wherein the knee brace is adjustable in both forward and backward directions to abut against the rear knee of various users.

6. The apparatus of claim 5 further comprising a support bar on a side of the apparatus opposite the platform at a base of the apparatus, said support bar resting against a ground surface in order to provide more stability to the apparatus.

7. The apparatus of claim 2 wherein the knee brace is adjustable in height to a height of various users' knees.

8. The apparatus of claim 7 wherein the knee brace is adjustable in both forward and backward directions to abut against the rear knee of various users.

9. The apparatus of claim 8 further comprising a support bar on a side of the apparatus opposite the platform at a base of the apparatus, said support bar resting against a ground surface in order to provide more stability to the apparatus.

10. The apparatus of claim 7 further comprising a support bar on a side of the apparatus opposite the platform at a base of the apparatus, said support bar resting against a ground surface in order to provide more stability to the apparatus.

11. The apparatus of claim 3 wherein the knee brace is adjustable in both forward and backward directions to abut against the rear knee of various users.

12. The apparatus of claim 11 further comprising a support bar on a side of the apparatus opposite the platform at a base of the apparatus, said support bar resting against a ground surface in order to provide more stability to the apparatus.

13. The apparatus of claim 3 further comprising a support bar on a side of the apparatus opposite the platform at a base of the apparatus, said support bar resting against a ground surface in order to provide more stability to the apparatus.

14. The apparatus of claim 4 further comprising a support bar on a side of the apparatus opposite the platform at a base of the apparatus, said support bar resting against a ground surface in order to provide more stability to the apparatus.

15. The apparatus of claim 2 wherein the knee brace is adjustable in both forward and backward directions to abut against the rear knee of various users.

16. The apparatus of claim 15 further comprising a support bar on a side of the apparatus opposite the platform at a base of the apparatus, said support bar resting against a ground surface in order to provide more stability to the apparatus.

17. The apparatus of claim 2 further comprising a support bar on a side of the apparatus opposite the platform at a base of the apparatus, said support bar resting against a ground surface in order to provide more stability to the apparatus.

18. The apparatus of claim 2 wherein the platform is marked with ball positioning and hitting direction aid lines.

19. The apparatus of claim 1 wherein the buttocks bar and hip bar are simultaneously adjustable in height to the height of various user's buttocks and hips.

20. The apparatus of claim 19 wherein the knee brace is adjustable in height to a height of various users' knees.

21. The apparatus of claim 20 wherein the knee brace is adjustable in both forward and backward directions to abut against the rear knee of various users.

22. The apparatus of claim 21 further comprising a support bar on a side of the apparatus opposite the platform at a base of the apparatus, said support bar resting against a ground surface in order to provide more stability to the apparatus.

23. The apparatus of claim 20 further comprising a support bar on a side of the apparatus opposite the platform at a base of the apparatus, said support bar resting against a ground surface in order to provide more stability to the apparatus.

24. The apparatus of claim 19 wherein the knee brace is adjustable in both forward and backward directions to abut against the rear knee of various users.

25. The apparatus of claim 24 further comprising a support bar on a side of the apparatus opposite the platform at a base of the apparatus, said support bar resting against a ground surface in order to provide more stability to the apparatus.

26. The apparatus of claim 19 further comprising a support bar on a side of the apparatus opposite the platform at a base of the apparatus, said support bar resting against a ground surface in order to provide more stability to the apparatus.

27. The apparatus of claim 1 wherein the knee brace is adjustable in height to a height of various users' knees.

28. The apparatus of claim 27 wherein the knee brace is adjustable in both forward and backward directions to abut against the rear knee of various users.

29. The apparatus of claim 28 further comprising a support bar on a side of the apparatus opposite the platform at a base of the apparatus, said support bar resting against a ground surface in order to provide more stability to the apparatus.

30. The apparatus of claim 27 further comprising a support bar on a side of the apparatus opposite the platform at a base of the apparatus, said support bar resting against a ground surface in order to provide more stability to the apparatus.

31. The apparatus of claim 1 wherein the knee brace is adjustable in both forward and backward directions to abut against the rear knee of various users.

32. The apparatus of claim 31 further comprising a support bar on a side of the apparatus opposite the platform at a base of the apparatus, said support bar resting against a ground surface in order to provide more stability to the apparatus.

* * * * *